US006056592A

United States Patent [19]

Hashizawa et al.

[11] Patent Number: 6,056,592

[45] Date of Patent: May 2, 2000

[54] CONNECTOR DEVICE EQUIPPED WITH SWITCH

[75] Inventors: Shigemi Hashizawa; Yutaka Masuda, both of Shizuoka; Kouichi Shirouzu, Aichi; Kazuyuki Shiraki, Aichi; Yoshihiro Kawashima, Aichi, all of Japan

[73] Assignee: Yazaki Corporation, Tokyo, Japan

[21] Appl. No.: 09/175,403

[22] Filed: Oct. 20, 1998

[30] Foreign Application Priority Data

Oct. 21, 1997 [JP] Japan ..... 9-288667

[51] Int. Cl.[7] ..... H01R 31/08

[52] U.S. Cl. ..... 439/509; 200/51.09; 439/952

[58] Field of Search ..... 439/509, 511, 439/512, 92, 513, 911, 942, 952; 200/51.09

[56] References Cited

U.S. PATENT DOCUMENTS

| | | | |
|---|---|---|---|
| 5,085,592 | 2/1992 | Sekiguchi | 439/188 |
| 5,151,053 | 9/1992 | Shinji et al. | 439/610 |
| 5,816,834 | 10/1998 | Nimura et al. | 439/188 |
| 5,921,810 | 7/1999 | Murakoshi | 439/510 |
| 5,928,021 | 7/1999 | Koch | 439/188 |

FOREIGN PATENT DOCUMENTS 7-326423 12/1995 Japan .

*Primary Examiner*—Neil Abrams
*Assistant Examiner*—Brian S. Webb
*Attorney, Agent, or Firm*—Armstrong, Westerman, Hattori, McLeland and Naughton

[57] ABSTRACT

A switch-equipped connector device, comprises: a case having an opening; a cover to be removably mounted on the case so as to cover the opening; a first connection terminal on the side of load and a second connection terminal on the side of a power supply, a connection portion between which is exposed from the opening, and which are held in the case; a short-circuiting terminal attached to the cover; a switch connector located in said opening, the switch connector to be electrically connected to the short-circuiting terminal in the opening, the short-circuiting terminal being disconnected from said switch connector when the cover is removed from the case; and a switching device connected to the second connection terminal through the power supply, the switching device interrupting power supply to the second connection terminal when the cover is removed from the case. In the above configuration, the switching device is operated when the short-circuiting terminal is electrically disengaged from the switch connector in a removed state of the cover so that power supply to the second connection terminal is interrupted. Therefore, when the cover is detached from the case for maintenance of the connector device, an operator can remove the connection terminal on the side of a power supply with safety without receiving electric shock.

3 Claims, 9 Drawing Sheets

CONNECTOR DEVICE EQUIPPED WITH SWITCH

BACKGROUD OF THE INVENTION

1. Field of the Invention

The present invention relates to a connector and more particularly, to a switch-equipped connector capable of interrupting power supply to a connection terminal on the side of a power supply.

2. Description of the Related Art

In a connector device for coupling a connector terminal on the side of a power supply from a battery in a motor vehicle with that of the side of a load, a high voltage is applied and a large current is caused to flow. Therefore, in removing the connection terminal for maintenance of the connector device or during the maintenance, a finger or hand of a worker or a tool might erroneously come in contact with the connector terminal so that the worker receives an electric shock.

A connector device for avoiding such a danger was proposed in JP-A-7-326,423.

FIGS. 9 and 10 are a longitudinal sectional view and a side view of the connector device disclosed in the above publication.

In these figures, a connector device, generally 1, includes a cover 2, a case 3, a female terminal 4 secured to the case 3, a male terminal 5 secured to the cover 2, and a pivot control means 8 composed of an engaging section 6 attached to the case 3, which is to be engaged with an engaging piece 7 extended from the cover 2.

The cover 2 includes a cover body 9, a pair of supporting pieces 10 extending in parallel integrally from the cover body 9, a pivot shaft 11 connecting the tips of the pair of supporting pieces 10, a pair of supporting pieces 12 extending in parallel integrally from the cover body 9 on the side opposite to the pivot shaft 11 with respect to the cover body 9, an operating lever 13 connecting the tips of the pair of supporting pieces 12, and a hood 14 extending toward the case 3.

The case 3 includes a case body 15 and a pair of supporting pieces 16 extending in parallel integrally from the outer surface of the case body 15 and each having a groove 16*a* formed at its tip with which the pivot shaft 11 of the cover 2 is rotatably engaged. The case body 15 has a step portion 15*a* corresponding to the hood 14.

A plurality of the female terminals 4 are housed in terminal chambers 17, and connected to electric wires, respectively. The male terminal 5 is formed in a U-shape and integrally molded to the body 9 of the cover 2.

On the other hand, as shown in FIG. 10, in the pivot control means 8, a first engagement protrusion 19 and a second engagement protrusion 20 are attached to the engagement piece 7 at positions opposite to each other.

In the above configuration, the connector device 1 operates as follows.

First, when the cover 2 is pivoted around the pivot shaft 11 by the operating lever 13 grasped by a hand, the male terminal 5 is disengaged from the pair of female terminals 4 so that it is also electrically disconnected from the electric wires 18 connected to the female terminals 4. When the cover 2 is further pivoted over a prescribed angle, the first engagement protrusion 19 of the engagement piece 7 formed integrally to the cover 2 is engaged with the engagement section 6 formed integrally to the case 3 so that the cover 2 cannot be further opened. In addition, the tip of the hood 14 is engaged with the step portion 15*a* so that the cover 2 is fixed in an open state for the case 3.

Thus, a fear that the cover 2 closes inadvertently so that the male terminal 5 is engaged with the female terminals 4 and a current flows through the electric wires can be eliminated.

Further, in the above state, since the hood 14 covers the female terminals 4, a finger or hand of a worker or a tool does not erroneously come in contact with the connector terminal, the worker does not suffer from an electric shock.

In the above prior art, when the cover is removed during maintenance, in order to prevent the worker from suffering from an electric shock owing to contact of his hand or finger and tool with the connection terminal, the hood for covering the connection terminal is attached to the cover, and/or the pivot control means for controlling the pivoting of the cover is provided.

However, provision of such an electric shock preventing means to the connector device makes the construction complicated, thereby adversely affecting the efficiency of a work, such as maintenance.

SUMMARY OF THE INVENTION

An object of the present invention is to provide a switch-equipped connector device capable of assuring safety of a worker during maintenance and greatly improving workability.

In order to attain the above object of the present invention, there is provided a switch-equipped connector device, comprising: a case having an opening; a cover to be removably mounted on the case so as to cover the opening; a first connection terminal on the side of load and a second connection terminal on the side of a power supply, a connection portion between which is exposed from the opening, and which are held in the case; a short-circuiting terminal attached to the cover; a switch connector located in said opening, the switch connector to be electrically connected to the short-circuiting terminal in the opening, the short-circuiting terminal being disconnected from said switch connector when the cover is removed from the case; and a switching device connected to the second connection terminal through the power supply, the switching device interrupting power supply to the second connection terminal when the cover is removed from the case.

In the above configuration, the switching device is operated when the short-circuiting terminal is electrically disengaged from the switch connector in a removed state of the cover so that power supply to the second connection terminal is interrupted. Therefore, when the cover is detached from the case for maintenance of the connector device, an operator can remove the connection terminal on the side of a power supply with safety without receiving electric shock.

Preferably, the connector switch has a spacer for adjusting a mounting state of said cover. This is efficient to prevent erroneous mounting of the cover.

The above and other objects and features of the present invention will be more apparent from the following description taken in conjunction with the accompanying drawings.

DESCRIPTION OF THE PREFERRED EMBODIMENT

Figure 1:
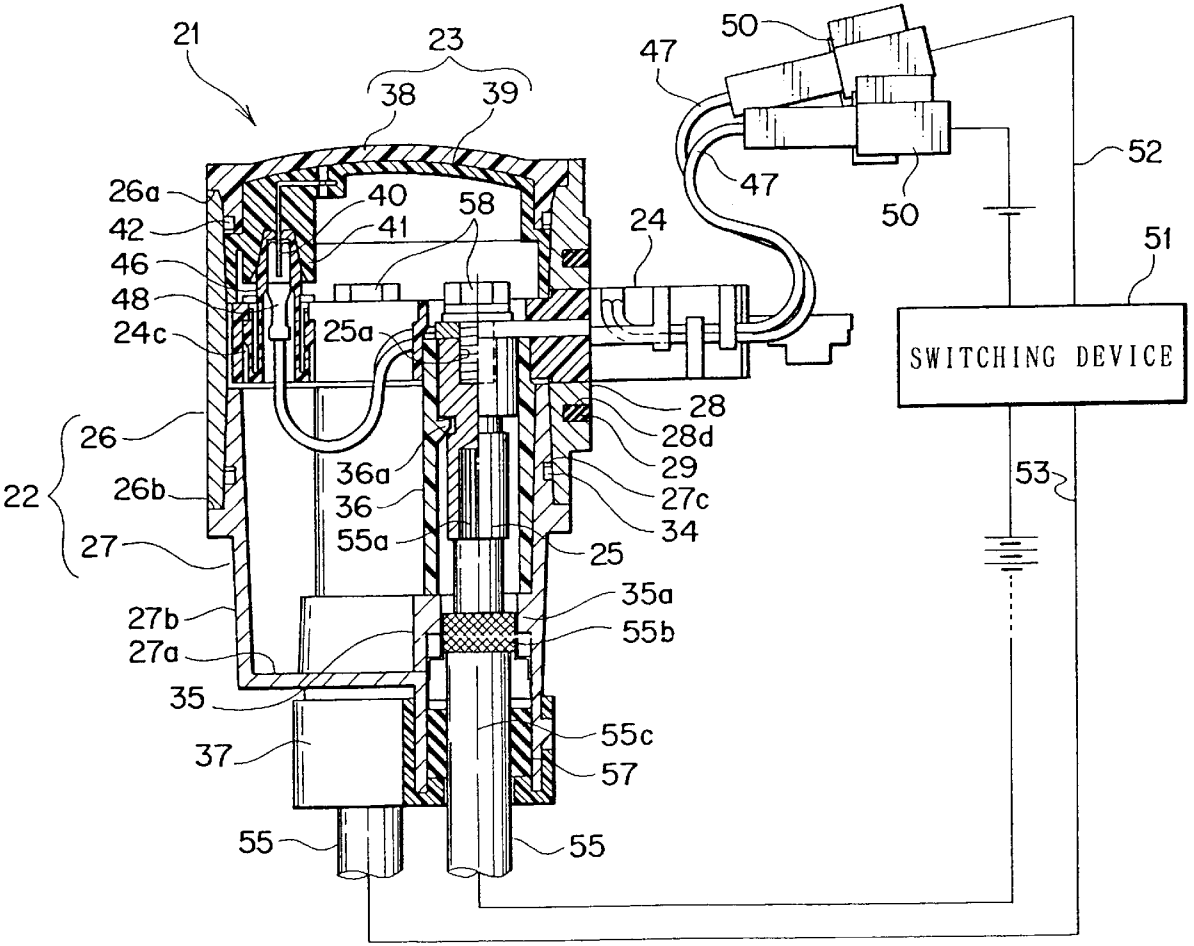
FIG. 1 is a longitudinal sectional view of an embodiment of a switch-equipped connector device according to the present invention.

Now referring to the drawings, an explanation will be given of an embodiment of the switch-equipped connector device according to the present invention.

In FIG. 1, a connector device 21 is designed to make an electric connection between a connection terminal on the side of a power supply and that on the side of a load in a motor vehicle and to operate a switching device externally provided to interrupt the electric power to be supplied to the connection terminal on the side of the power supply. The connector device 21 equipped with such a switching device includes a case 22, a cover 23, a cluster 24 of connection terminals on the side of a load, and a connection terminal 25 on the side of a power supply.

The case 22 is formed in the form of a cylinder made of metal, such as aluminum. The case 22 includes two components of a case body 26 and an electric wire holding case 27.

Figure 3:
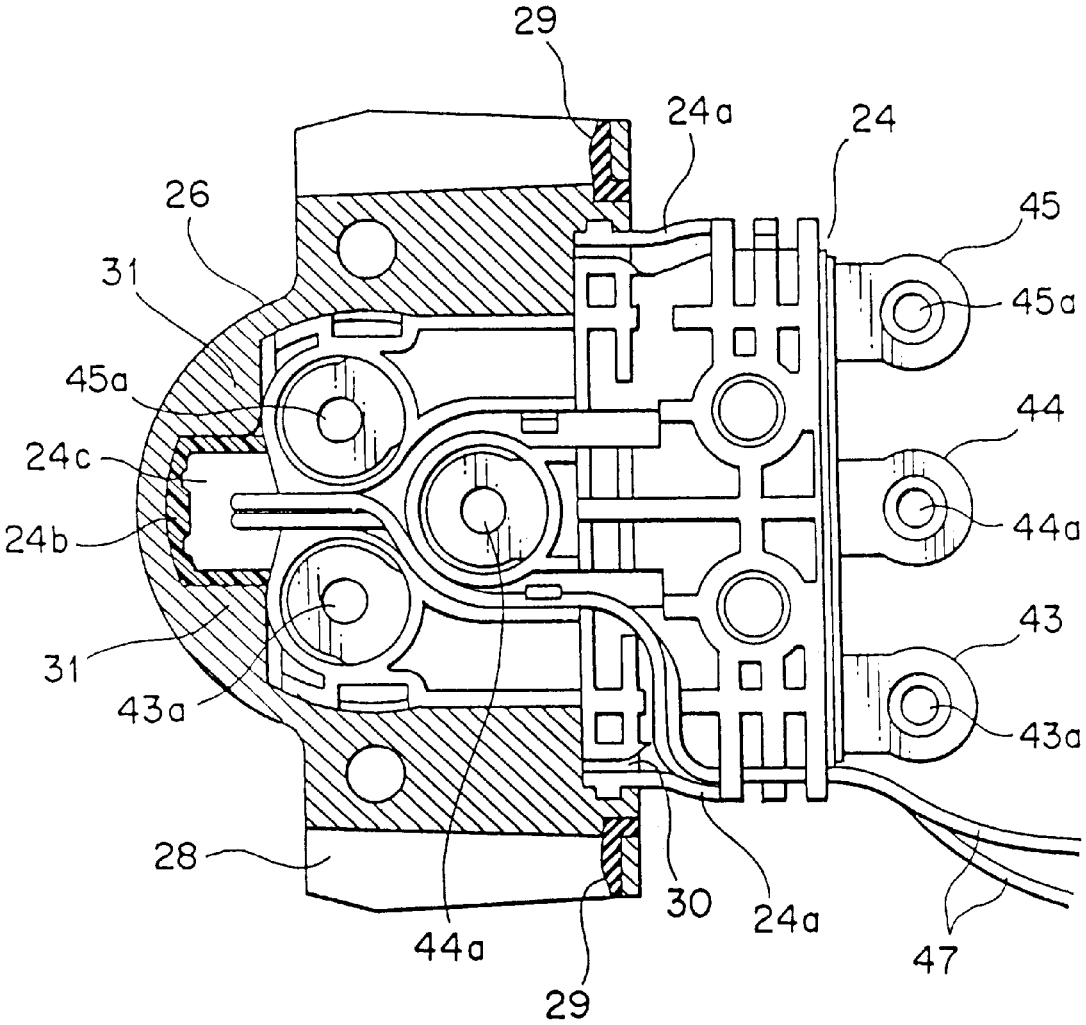
FIG. 3 is a sectional view taken in line A—A in FIG. 2.
Figure 4:
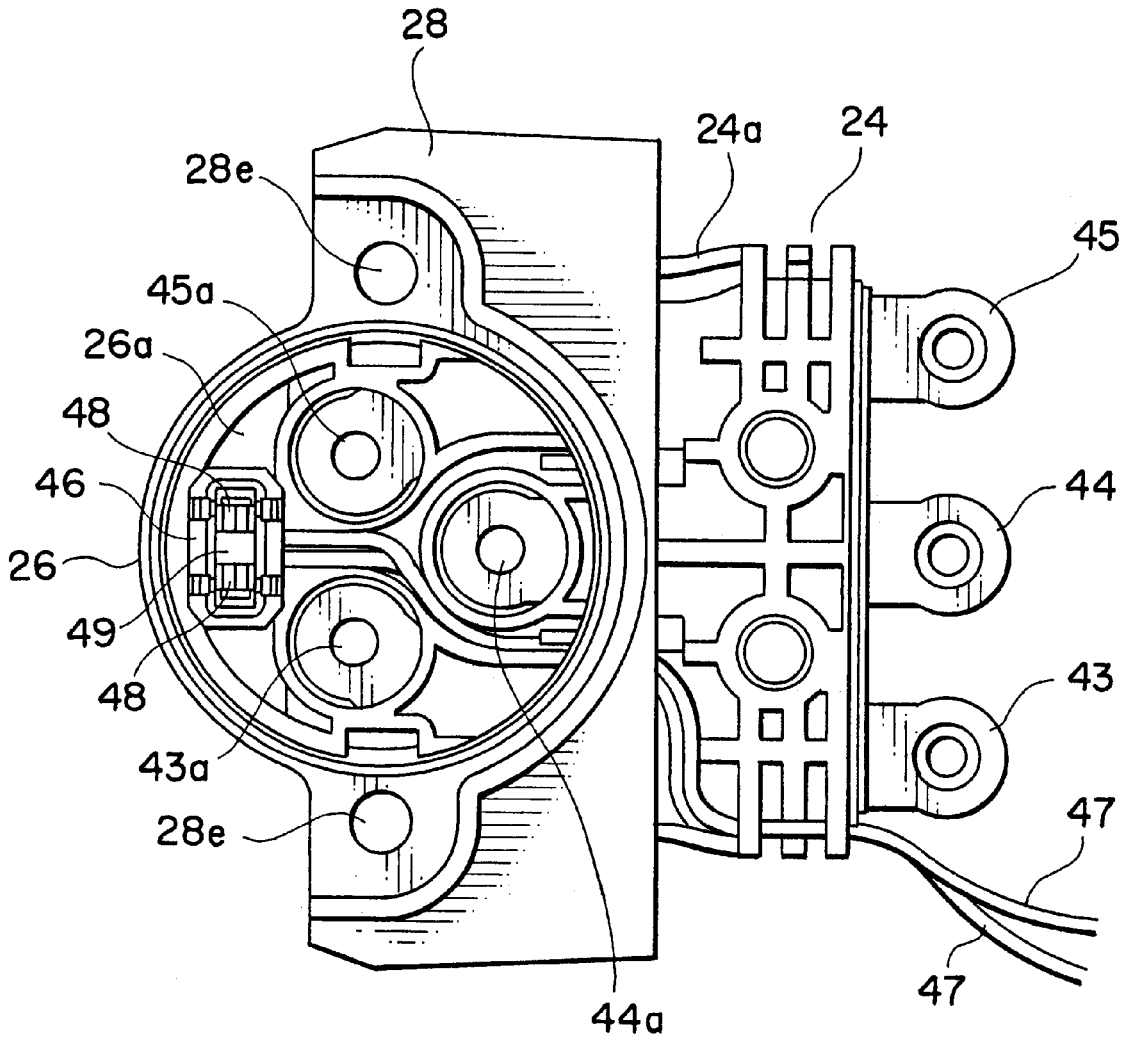
FIG. 4 is a top view of the switch-equipped connector device shown in FIG. 1 when its cover is removed.

The case body 26 has first and second openings 26*a* and 26*b* at both ends. The cover 23 is removably mounted in the first opening 26*a*, and the electric wire holding case 27 is fit in the second opening 26*b*. The case body 26 has an attachment section 28 formed on the outer wall and to be coupled with a securing section of another connector (not shown). On the front surface of the attachment section 28, four screw holes 28*b* are formed to extend to the rear face thereof. An elliptical groove 28*d* is also formed and filled with sealant of silicon rubber 29. An opening 30 for the cluster 24 of connection terminals is also formed (FIG. 3). The attachment section 28 has a pair of screw holes 28*e* penetrating in an axial direction and used for attachment of the cover 23 and electric wire holding case 27 (FIG. 4).

On the inner wall of the case body 26, a pair of engagement pieces 31 and a pair of engagement protrusions for the electric wire holding case 27 are formed (FIG. 3).

The electric wire holding case 27 is formed in a cup-shape having a bottom wall 27*a*. At the intermediate areas of the outer wall 27*b*, a pair of engagement portions 33 having screw holes (not shown) are formed to correspond to the screw holes of the case body 26. A groove 27*c* is formed circumferencially in the vicinity of the engagement portions 33. An O-ring 34 made of silicon rubber is mounted in the groove 27*c*. On the bottom wall 27*a*, three holding cylinders 35 are formed to protrude into and from the electric wire holding case 27. Above each holding cylinder 35, a terminal chamber 36 having an engagement protrusion 36*a* is formed. At the upper area on the inner wall of the holding cylinder 35, an engagement step 35*a* is circumferencially formed. A shell member is mounted at the intermediate position on the inner wall of the holding case 27. The outer periphery of the holding cylinder 35 externally protruding from the bottom wall 27*a* of the electric wire holding case 27 is covered with a rear holding body 37 having a section of a triangular shape.

The cover 23 is injection-molded using synthetic resin, and is composed of two components of an outer cover 38 and an inner cover 39. The outer cover 38 has engagement portions 38*a* (FIG. 2) each having a screw hole (not shown) corresponding to the screw hole 28*e* of the case body 26 (FIG. 4). The inner cover 39 is integrally provided with a connector 41 with a molded U-shaped short-circuiting terminal 40. An O-ring 42 of silicon rubber (FIG. 8) is mounted at the outer peripheral position of the boundary between the outer cover 38 and inner cover 39.

The cluster 24 of connection terminals is connected to an inverter (not shown) and is composed of three bus bars 43, 44 and 45, serving as connection terminals on the side of load. Each ofthe bus bars 43, 44 and 45 has a screw hole 43*a*, 44*a* and 45*a*, respectively, formed at both ends, as shown in FIG. 3. These bus bars 43, 44 and 45 are integrally attached to the cluster by encasing them during molding using synthetic resin.

The cluster 24 has elastic engaging pieces 24*a* to be engaged with the attachment section 28 of the case body 26. The cluster 24 has recesses (not shown) at the tip 24*b* corresponding to the engagement pieces 31 of the case body 26. The cluster 24 has an engagement hole 24*c* at the tip 24*b*, into which a switch connector 46 (FIG. 5) described later can be inserted. When the cluster 24, which is inserted from an opening 30 of the attachment portion 28, is positioned, as shown in FIG. 4, the tip area of each of the three bus bars 43, 44 and 45, to be connected to the connection terminal 25 on the side of a power supply (FIG. 1), and the switch connector 46 described later will be exposed from the one opening 26*a* of the case body 26. Thus, the workability of maintenance can be improved greatly.

Figure 5:
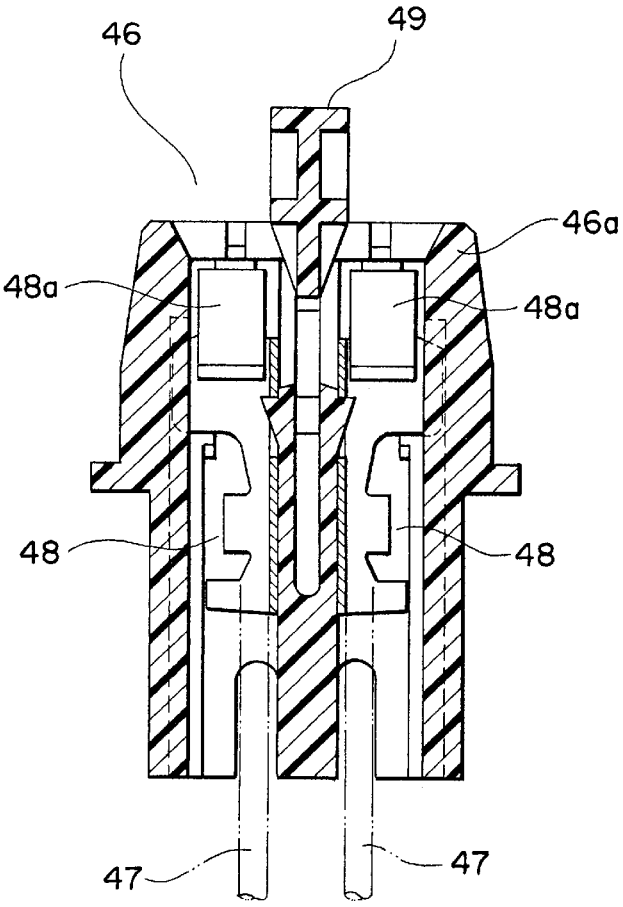
FIG. 5 is an enlarged sectional view of a switch connector attached to the connector device shown in FIG. 1 when it is viewed from its front.
Figure 6:
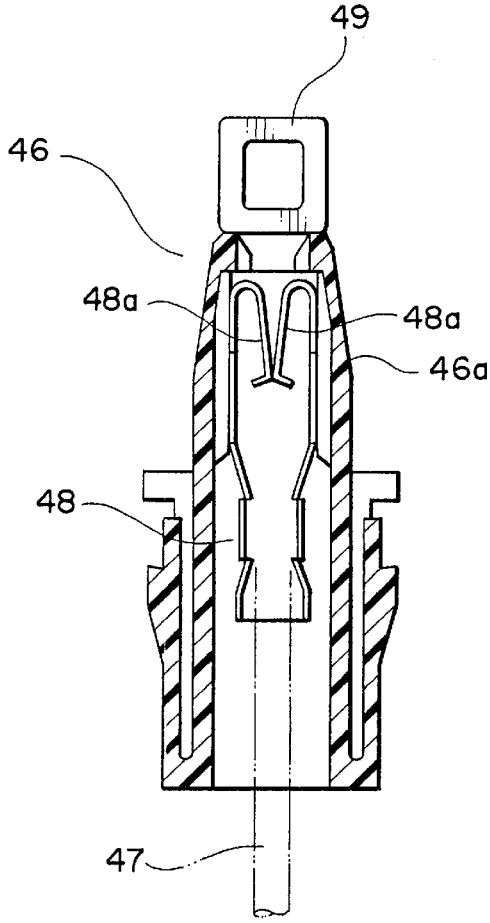
FIG. 6 is an enlarged sectional view of a switch connector attached to the connector device shown in FIG. 1 when it is viewed from its side.
Figure 7:
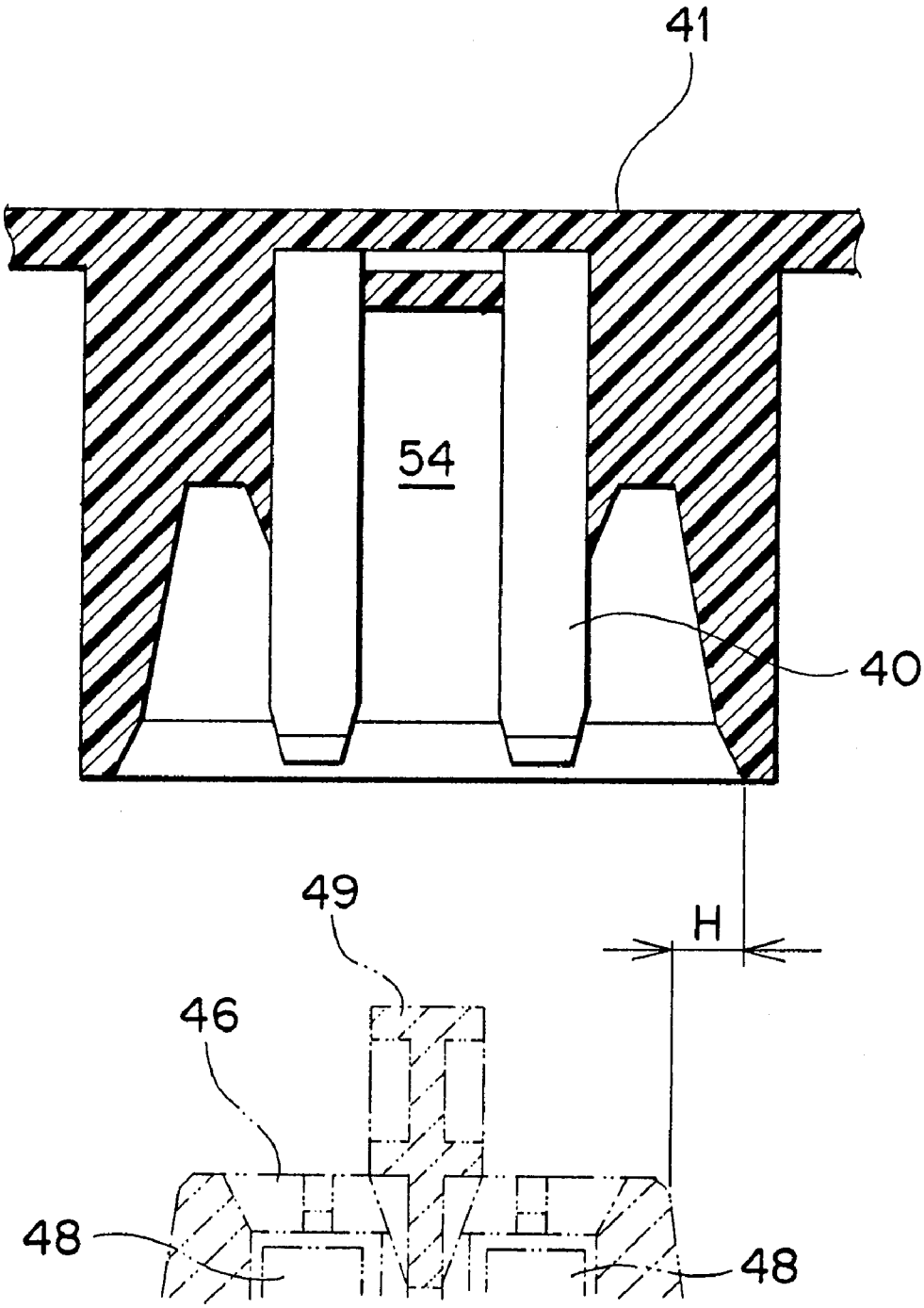
FIG. 7 is an enlarged sectional view of short-circuiting terminals attached to the switch-equipped connector device shown in FIG. 1 when they are viewed from their front.

The switch connector 46, as shown in FIGS. 5 and 6, is composed of a housing 46*a* and bipolar female terminals 48 housed within the housing 46*a* and connected to the tips of the electric wires 47, respectively. The female terminal 48 has elastic contact pieces 48*a* for sandwiching the short-circuiting terminal 40 (FIG. 7). The female terminal 48, which is housed in the housing 46*a* as shown, cannot be brought into touch with a finger or hand.

In the switch connector 46, as shown in FIGS. 5 and 6, a spacer 49 is fit between the female terminals 48 at the tip of the housing 46*a* (i.e. engaging side of the short-circuiting terminal 40 shown in FIG. 7). The spacer 49 serves to prevent erroneous assembling of the cover 23. It is efficient when the cover 23 is erroneously oriented by e.g. 180 degrees.

On the other hand, as shown in FIG. 1, the electric wires 47 extended externally of the case 22 from the switch connector 46 are connected to connectors 50, respectively, thereby constituting a part of a small current circuit 52 of a switching circuit 51 (which may be a relay (not shown) in this embodiment).

The switching device 51 operates when the short-circuiting terminal 40 is disengaged from the switch connector 46, i.e. cover 23 is removed from the case 22. When the switching device 51 operates, power supply from a large current circuit 53 for supplying power to the connection terminal 25 on the side of a power supply is interrupted.

Figure 8:
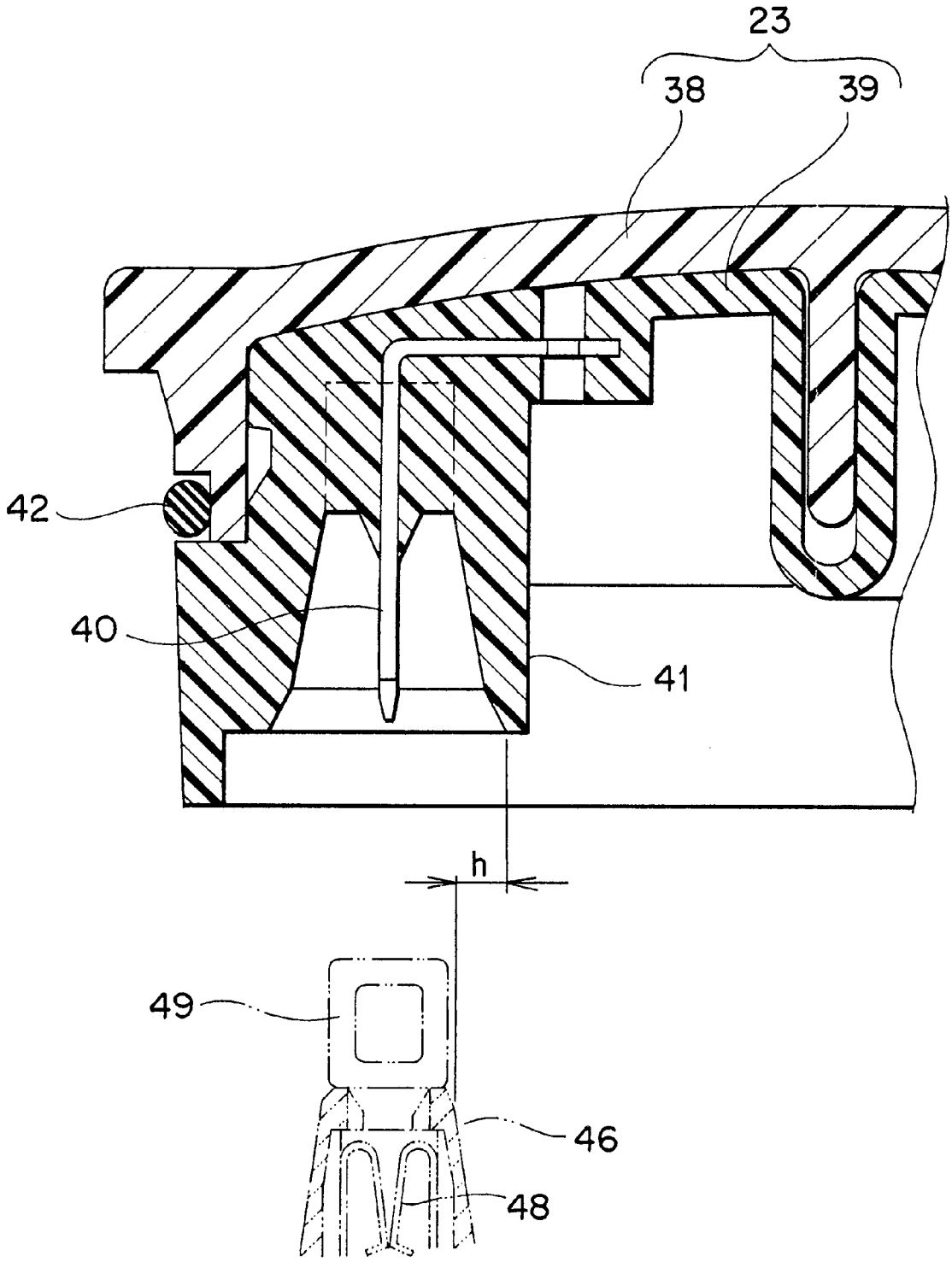
FIG. 8 is an enlarged sectional view of short-circuiting terminals attached to the switch-equipped connector device shown in FIG. 1 when they are viewed from their side.
Figure 9:
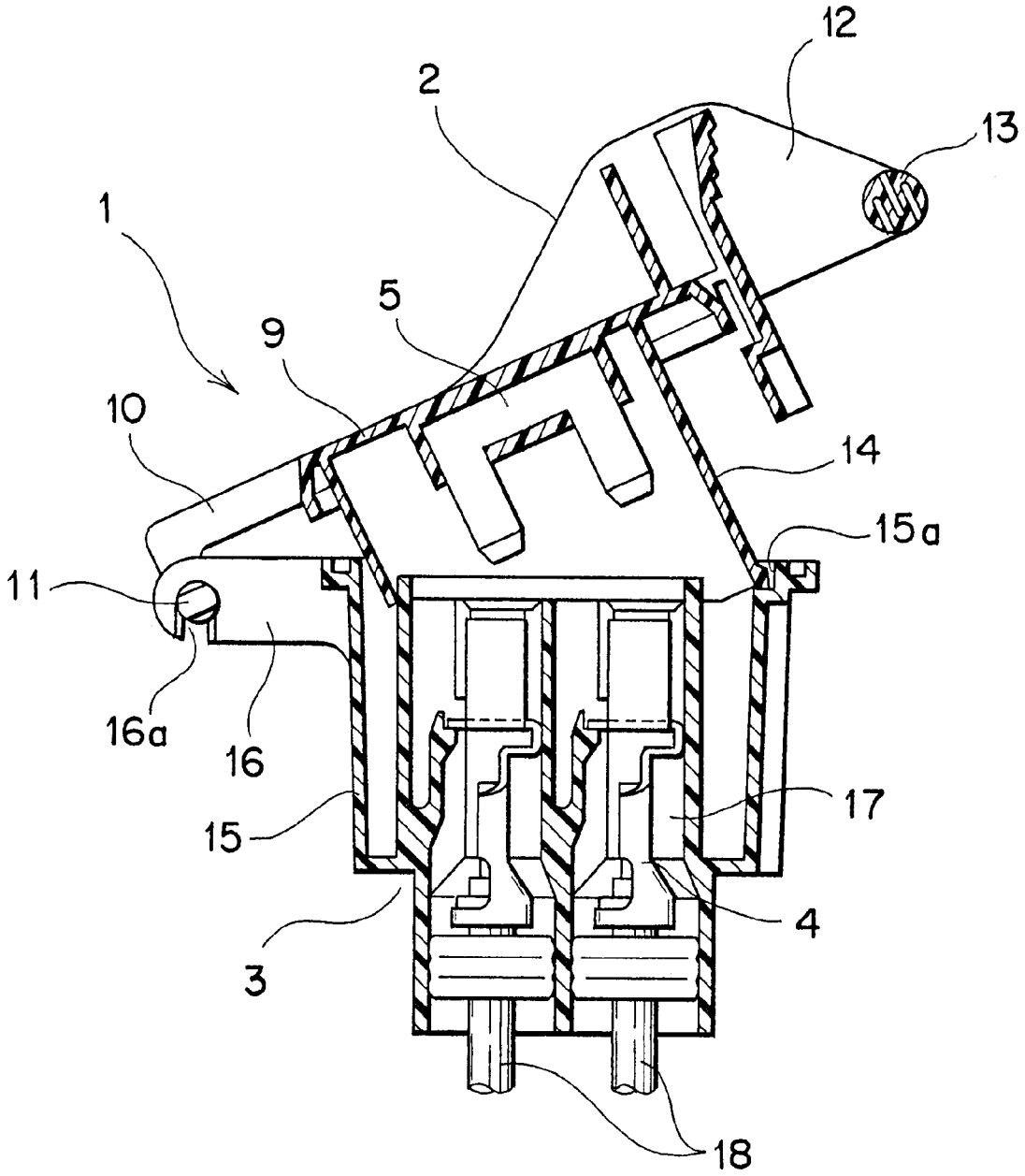
FIG. 9 PRIOR ART
FIG. 9 is a longitudinal sectional view of a conventional connector device.
Figure 10:
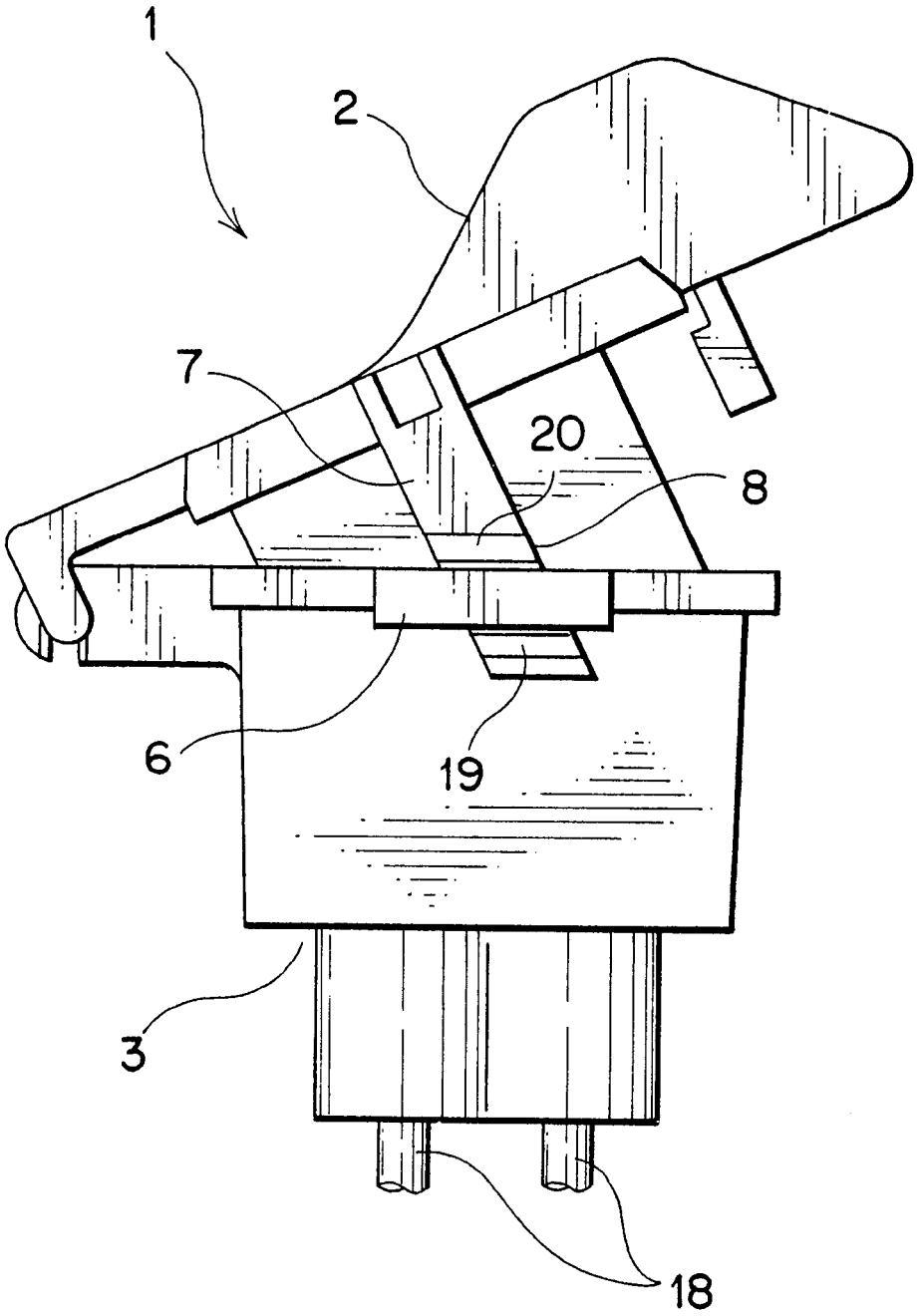
FIG. 10 PRIOR ART
FIG. 10 is a side view of the conventional connector device.

Now referring to FIGS. 7 and 8, an explanation will be given of the relative location between the connector 41 with the short-circuiting terminal 40 molded and the switch connector 46.

The connector 41 has an accommodation space 54 (FIG. 7) corresponding to the spacer 49 formed centrally in its interior. The connector 41 has a width designed so that the interval H (FIG. 7) or interval h (FIG. 8) between the inner edge of the connector 41 and the outer edge of the switch connector 46 is as large as possible in view of the capability of attaching the cover 23.

As shown in FIG. 1, the connection terminals 25 on the side of a power supply have female screw portions 25*a* so as to correspond to the cluster 24 of connection terminals and connected to three (only two are shown) shield electric wires 55, respectively.

The shield electric wire 55 has a core line 55*a* connected to the connection terminal 25 at its stripped end portion, a woven portion 55*b* connected to ground in engagement with a shell member (not shown) attached to a holding cylinder 35 and a sheath 55*c* covered with a rubber stopper 57 for water-proof of the holding cylinder 35.

The switch-equipped connector device 21 is assembled through the following process (FIG. 1).

First, the cluster 24 of connection terminals is inserted from the opening 30 of the case body 26 (FIG. 3) so that its elastic engagement pieces 24*a* are fit in the attaching portion 28. The switch connector 46 is mounted in the engagement hole 24*c* of the cluster 24. The electric wires 47 of the switch connector 46 are previously extended out from the opening 30.

Figure 2:
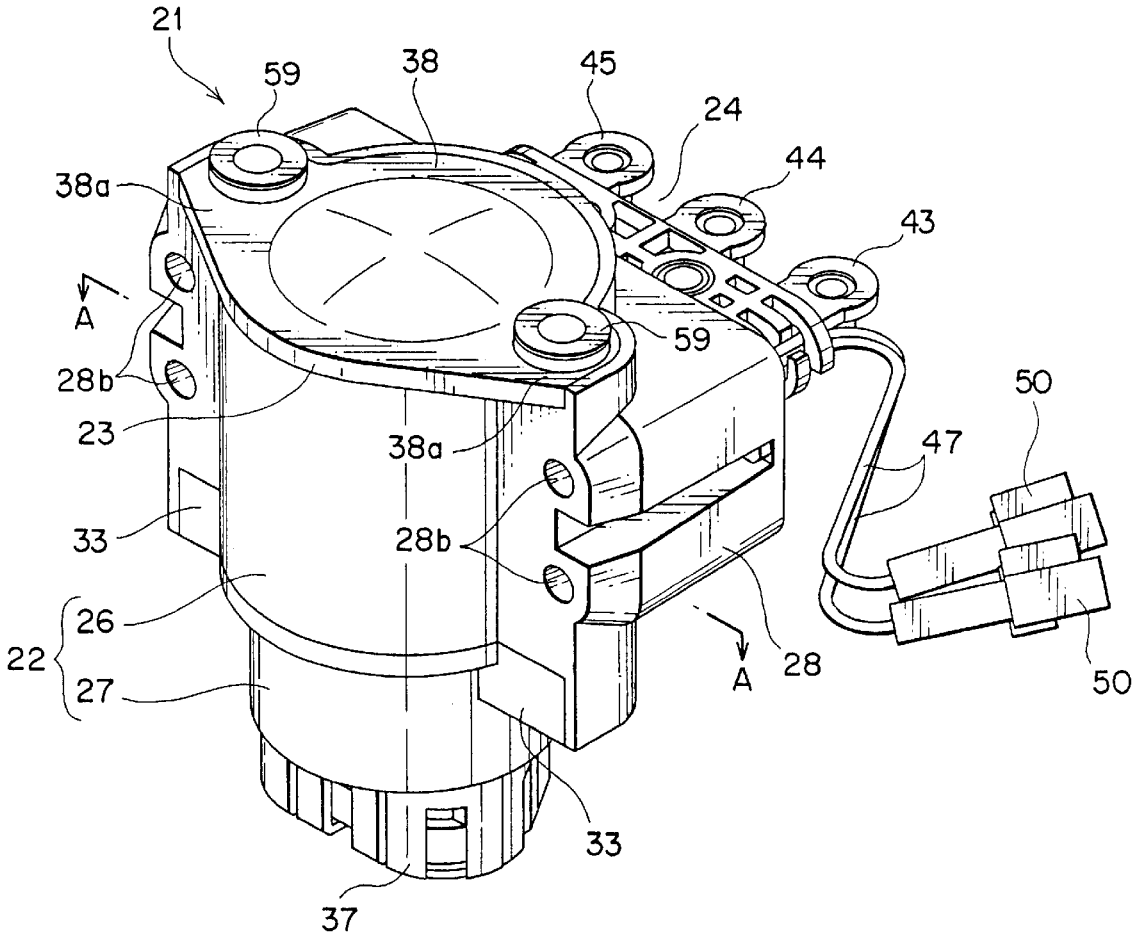
FIG. 2 is a perspective view of the appearance of the switch-equipped connector device shown in FIG. 1.

The shield electric wires 55 connected to the connection terminals 25 are mounted in the electric holding case 27. The electric holding case 27 is inserted in the other opening 26*b* of the case body 26. The connection terminals 25 and the bus bars 43, 44 and 45 (FIG. 3) are secured through the one opening 26*a* of the case body 26 using bolts 58. Thereafter, the cover 23 is placed on the case body 26, and the connector 41 is engaged with the switch connector 46. The cover 23, case body 26 and electric wire holding case 27 are integrally fixed by bolts 59 (FIG. 2). The connectors 50 coupled with the electric wires 47 are connected to the small current circuit 52.

An explanation will be given of the operation of the switch-equipped connector 21 thus assembled.

In order to remove the connection terminals 25 on the side of a power supply for maintenance of the switch-equipped connector device 21, the cover 23 is detached from the case 22. Then, the connector 41 is disengaged from the switch connector 46 so that the switching device 51 operates. Thus, supply of electric power from the large current circuit 53 is interrupted.

Accordingly, when the cover 23 is detached from the case 23, no large current flows through the connection portion between the connection terminal 25 and the cluster 24 of connection terminals. Therefore, an operator can remove the connection terminals 25 with safety.

In the switch-equipped connector device 21 according to the embodiment described above, the switching device 51 is operated by the short-circuiting terminal 40 and switch connector 46. But, the arrangement of the short-circuiting terminal 40 and switch connector 46 may be modified.

What is claimed is:

1. A connector device equipped with a switch, comprising:

a case having an opening;

a cover to be removably mounted on the case so as to cover the opening;

a first connection terminal on the side of load and a second connection terminal on the side of a power supply, a connection portion between which is exposed from said opening, and which are held in said case;

a short-circuiting terminal attached to said cover;

a switch connector located in said opening, said switch connector to be electrically connected to said short-circuiting terminal in said opening, said short-circuiting terminal being disconnected from said switch connector when said cover is removed from said case; and a switching device connected to the second connection terminal through the power supply, said switching device interrupting power supply to said second connection terminal when said cover is removed from said case.

2. A switch-equipped connector device according to claim 1, wherein said connector switch has a spacer for adjusting a mounting state of said cover.

3. A switch-equipped connector device according to claim 1, wherein said short-circuiting terminal is formed in a molding and a spacer is fit in said molding.

* * * * *